US008662820B2

(12) United States Patent
Sathyanarayana et al.

(10) Patent No.: US 8,662,820 B2
(45) Date of Patent: Mar. 4, 2014

(54) METHOD FOR SHUTTING DOWN A TURBOMACHINE

(75) Inventors: Dileep Sathyanarayana, Clifton Park, NY (US); Steven Craig Kluge, Burnt Hills, NY (US); Dean Alexander Baker, Clifton Park, NY (US); Steven Di Palma, Sterling, MA (US)

(73) Assignee: General Electric Company, Schenectady, NY (US)

( * ) Notice: Subject to any disclaimer, the term of this patent is extended or adjusted under 35 U.S.C. 154(b) by 630 days.

(21) Appl. No.: 12/969,889

(22) Filed: Dec. 16, 2010

(65) Prior Publication Data

US 2012/0156004 A1 Jun. 21, 2012

(51) Int. Cl.
*F01D 21/00* (2006.01)

(52) U.S. Cl.
USPC ..... 415/1; 415/36

(58) Field of Classification Search
USPC ..... 415/1, 13, 20, 30, 36; 60/646
See application file for complete search history.

(56) References Cited

U.S. PATENT DOCUMENTS

| | | | |
|---|---|---|---|
| 4,228,359 A | 10/1980 | Matsumoto et al. | |
| 4,320,625 A | 3/1982 | Westphal et al. | |
| 4,329,592 A | 5/1982 | Wagner et al. | |
| 4,353,216 A | 10/1982 | Dickenson | |
| 4,561,254 A | 12/1985 | Martens et al. | |
| 4,957,410 A | 9/1990 | Silvestri, Jr. et al. | |
| 4,965,221 A | 10/1990 | Dennison et al. | |
| 5,361,585 A | 11/1994 | Westphal et al. | |
| 6,647,728 B2 | 11/2003 | Seitz | |
| 6,939,100 B2 | 9/2005 | Kirchhof | |
| 7,028,479 B2 * | 4/2006 | Gobrecht et al. | 60/646 |
| 7,632,059 B2 | 12/2009 | Tisenchek et al. | |

FOREIGN PATENT DOCUMENTS

| | | | |
|---|---|---|---|
| DE | 102007029573 A1 | | 1/2008 |
| JP | S61212607 A | | 9/1986 |
| JP | 62-189304 | * | 8/1987 |
| JP | H08296405 A | | 11/1996 |
| WO | 0157366 A1 | | 8/2001 |
| WO | 01/92689 A1 | | 12/2001 |

OTHER PUBLICATIONS

Kaneda, Method for Controlling Combined Plant, Aug. 19, 1987, Abstract of JP 62-189304.*
Search report issued in connection with EP Application No. 11192395.9, Jul. 5, 2013.
Search Report and Written Opinion from corresponding EP Application No. 1119239.0-1610 dated Jul. 5, 2013.

* cited by examiner

*Primary Examiner* — Edward Look
*Assistant Examiner* — Liam McDowell
(74) *Attorney, Agent, or Firm* — Ernest G. Cusick; Frank A. Landgraff

(57) ABSTRACT

A method for increasing the operational flexibility of a turbomachine during a shutdown phase is provided. The turbomachine may include a first section, a second section, and a rotor disposed within the first section and the second section. The method may determine an allowable range of a physical parameter associated with the first section and/or the second section. The method may modulate a first valve and/or a second valve to allow steam flow into the first section and the second section respectively, wherein the modulation is based on the allowable range of the physical parameter. In addition, the physical parameter allows the method to independently apportion steam flow between the first section and the second section of the turbomachine, during the shutdown phase.

11 Claims, 5 Drawing Sheets

METHOD FOR SHUTTING DOWN A TURBOMACHINE

BACKGROUND OF THE INVENTION

This application is related to commonly-assigned U.S. patent application Ser. No. 12/969,861, filed Dec. 16, 2010; U.S. patent application Ser. No. 12/969,876, filed Dec. 16, 2010; and U.S. patent application Ser. No. 12/969,906, filed Dec. 16, 2010.

The present invention relates generally to turbomachines and more particularly to a method for enhancing the operational flexibility of a steam turbine during a shutdown phase.

Steam turbines are commonly used in power plants, heat generation systems, marine propulsion systems, and other heat and power applications. Steam turbines typically include at least one section that operates within a pre-determined pressure range. This may include: a high-pressure (HP) section; and a reheat or intermediate pressure (IP) section. The rotating elements housed within these sections are commonly mounted on an axial shaft. Generally, control valves and intercept valves control steam flow through the HP and the IP sections, respectively.

The normal operation of a steam turbine includes three distinct phases; which are startup, loading, and shutdown. The startup phase may be considered the operational phase beginning in which the rotating elements begin to roll until steam is flowing through all sections. Generally, the startup phase does not end at a specific load. The loading phase may be considered the operational phase in which the quantity of steam entering the sections is increased until the output of the steam turbine is approximately a desired load; such as, but not limiting to, the rated load. The shutdown phase may be considered the operational phase in which the steam turbine load is reduced, and steam flow into each section is gradually stopped and the rotor, upon which the rotating elements are mounted, is slowed to a turning gear speed.

The shutdown phase for steam turbines equipped with cascade steam bypass systems may impose unique operational characteristics, which may overload the thrust bearings. A conventional shutdown strategy can involve a flow-balancing process that balances flow between the HP and IP sections until a HP forward flow mode ends. Forward flow may be considered steam flowing, in a forward direction, through the HP section. During HP forward flow mode, steam flow through the HP and IP sections is fairly balanced. Here, the flow rate typically depends on the operating reheat (RH) pressure.

There are a few drawbacks with the conventional shutdown strategy. Flow-balancing strategies may not effectively manage competing physical requirements. Here, a single physical requirement or parameter can limit the operation of the entire steam turbine. Furthermore, determining when to terminate the HP forward flow mode may be an issue. If the HP forward flow mode is terminated early in the shutdown process, the resulting high flow rate may increase the thrust load. If the HP forward flow mode is terminated later in the shutdown process, undesirably high HP section exhaust temperatures may result, possibly due to RH pressure issues.

These issues reduce the operational flexibility, require larger mechanical components, and potentially reduce the net-output delivered by the steam turbine during the shutdown phase. Therefore, there is a desire for a method for increasing the operational flexibility of the steam turbine during the shutdown phase.

BRIEF DESCRIPTION OF THE INVENTION

In accordance with an embodiment of the present invention, a method of reducing steam flow during a shutdown phase of a turbomachine, the method comprising: providing a turbomachine comprising at least a first section and a second section, and a rotor partially disposed within the first section and the second section; providing a first valve configured for controlling steam flow into the first section; and a second valve configured for controlling steam flow into the second section; determining whether the turbomachine is operating in a shutdown phase; which begins when an operator initiates a shutdown sequence, and ends when a load on the turbomachine is reduced and steam flow into each section is gradually stopped and the rotor is slowed to a turning gear speed; determining an allowable turbine allowable turbine operating space (ATOS), wherein ATOS incorporates data on at least one of the following, but not limited to: steam flow through each section, a thrust limit of each section, and an exhaust windage limit to approximate operational boundaries for each section of the turbomachine; determining an allowable range within ATOS of a physical parameter associated with the shutdown phase; modulating the first valve to reduce steam flow into the first section, wherein the modulation is partially limited, by the allowable range of the physical parameter; modulating the second valve to reduce steam flow into the second section, wherein the modulation is partially limited by the allowable range of the physical parameter; and wherein ATOS, in real time, expands operational boundaries of the first section and the second section, and allows unbalanced steam flow between the first section and the second section of the turbomachine during the shutdown phase.

In accordance with an alternate embodiment of the present invention, the method independently apportioning steam flow between sections of a steam turbine during a shutdown process, the method comprising: providing a power plant comprising a steam turbine, wherein the steam turbine comprises a HP section, an IP section, and a rotor partially disposed within the HP and IP sections; providing a first valve configured for controlling steam flow entering the HP section; and a second valve configured for controlling steam flow entering the IP section; determining whether the steam turbine is operating in a shutdown phase; determining an allowable turbine operating space (ATOS), wherein ATOS incorporates data on a least one of the following: steam flow through each section, a thrust limit of each section, and an exhaust windage limit to approximate operational boundaries for each section of the turbomachine; determining an allowable range within ATOS of a physical parameter associated with at least one of the first section or the second section; generating a range of valve strokes for the first and second valves based on the allowable range of the physical parameter; modulating the first valve to reduce steam flow into the HP section, wherein the modulation limits the range of valve strokes for the first valve; and modulating the second valve to reduce steam flow into the IP section, wherein the modulation limits the range of valve strokes for the second valve; and wherein the physical parameter allows apportioning steam flow into the HP and the IP sections, during the shutdown phase of the steam turbine.

DETAILED DESCRIPTION OF THE INVENTION

Figure 1:
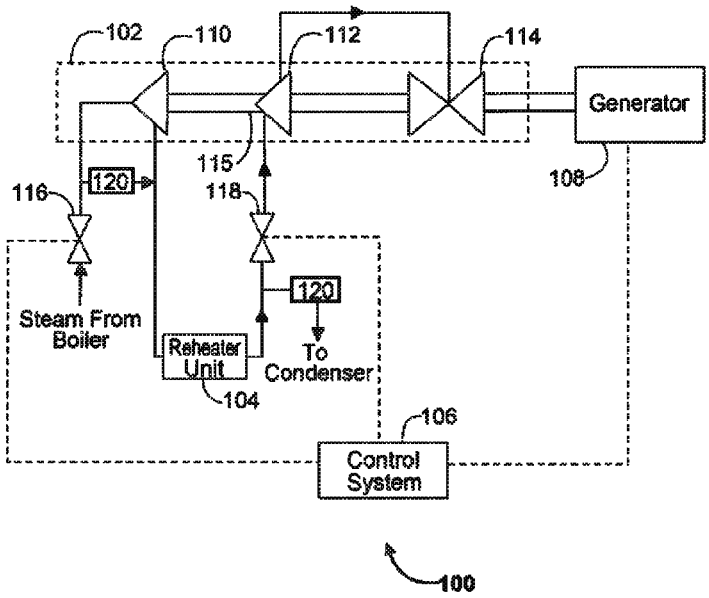
FIG. 1 PRIOR ART
FIG. 1 is a schematic illustrating a powerplant site, of which an embodiment of the present invention may operate.

The present invention has the technical effect of expanding the operational flexibility of a steam turbine during a shutdown phase. As the steam turbine operates, the present invention determines the Allowable Turbine Operating Space (ATOS) of each section. Next, the present invention may reduce the steam entering each turbine section based on the current ATOS, as the steam turbine is shutting down. Here, the quantity steam flow entering each turbine section is not dependent on the quantity of steam flow entering another turbine section.

The following detailed description of preferred embodiments refers to the accompanying drawings, which illustrate specific embodiments of the invention. Other embodiments having different structures and operations do not depart from the scope of the present invention.

Certain terminology may be used herein for the convenience of the reader only and is not to be taken as a limitation on the scope of the invention. For example, words such as "upper", "lower", "left", "right", "front", "rear", "top", "bottom", "horizontal", "vertical", "upstream", "downstream", "fore", "aft", and the like; merely describe the configuration shown in the Figures. Indeed, the element or elements of an embodiment of the present invention may be oriented in any direction and the terminology, therefore, should be understood as encompassing such variations unless specified otherwise.

Detailed example embodiments are disclosed herein. However, specific structural and functional details disclosed herein are merely representative for purposes of describing example embodiments. Example embodiments may, however, be embodied in many alternate forms, and should not be construed as limited to only the embodiments set forth herein.

Accordingly, while example embodiments are capable of various modifications and alternative forms, embodiments thereof are illustrated by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any, and all, combinations of one or more of the associated listed items.

The terminology used herein is for describing particular embodiments only and is not intended to be limiting of example embodiments. As used herein, the singular forms "a", "an" and "the" are intended to include the plural forms as well, unless the context clearly indicates otherwise. The terms "comprises", "comprising", "includes" and/or "including", when used herein, specify the presence of stated features, integers, steps, operations, elements, and/or components, but do not preclude the presence or addition of one or more other features, integers, steps, operations, elements, components, and/or groups thereof.

The present invention may be applied to a variety of steam turbines, or the like. An embodiment of the present invention may be applied to either a single steam turbine or a plurality of steam turbines. Although the following discussion relates to a steam turbine having an opposed flow configuration and a cascade steam bypass system, embodiments of the present invention are not limited to that configuration. Embodiments of the present invention may apply to other configurations that are not opposed flow and/or not equipped with a cascade steam bypass system.

Referring now to figures, where the various numbers represent like elements through the several views, FIG. 1 is a schematic illustrating a steam turbine 102 on a site 100, such as, but not limiting of: a power plant site 100. FIG. 1 illustrates the site 100 having the steam turbine 102, a reheater unit 104, a control system 106, and an electric generator 108.

FIG. 1, the steam turbine 102 may include a first section 110, a second section 112, and a cascade steam bypass system 120. In various embodiments of the present invention, the first section 110, and the second section 112 of the steam turbine 102 may be a high pressure (HP) section 110, an intermediate pressure (IP) section 112. In various other embodiments of the present invention, the HP section 110 may also be referred to as a housing 110 and the IP section 112 may also be referred to as an additional housing 112. Further, the steam turbine 102 may also include a third section 114. In an embodiment of the present invention, the third section 114 may be a low pressure (LP) section 114. The steam turbine 102 may also include a rotor 115, which may be disposed within the sections 110, 112 and 114 of the steam turbine 102. In an embodiment of the present invention, a flow path around the rotor 115 may allow the steam to fluidly communicate between the sections 110, 112 and 114.

The steam turbine 102 may include a first valve 116 and a second valve 118 for controlling the steam flow entering the first section 110 and the second section 112, respectively. In various embodiments of the present invention, the first valve 116 and the second valve 118 may be a control valve 116 and an intercept valve 118 for controlling the steam flow entering the HP section 110 and the IP section 112, respectively.

Figure 2:
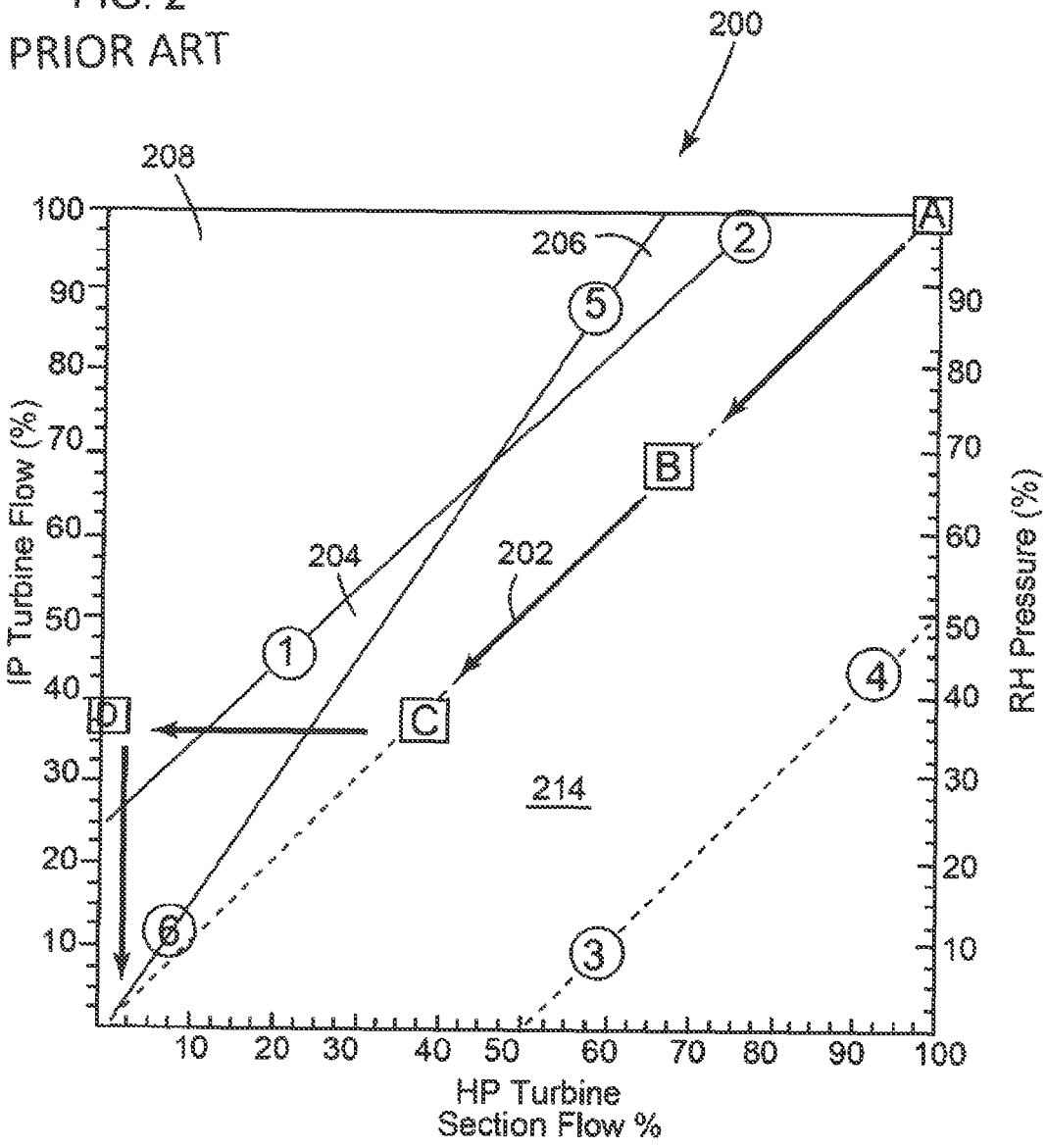
FIG. 2 PRIOR ART
FIG. 2 is a chart illustrating IP section flow versus HP section flow and RH pressure versus HP section flow for the steam turbine in an ATOS environment, in accordance with a known shutdown methodology.
Figure 3:
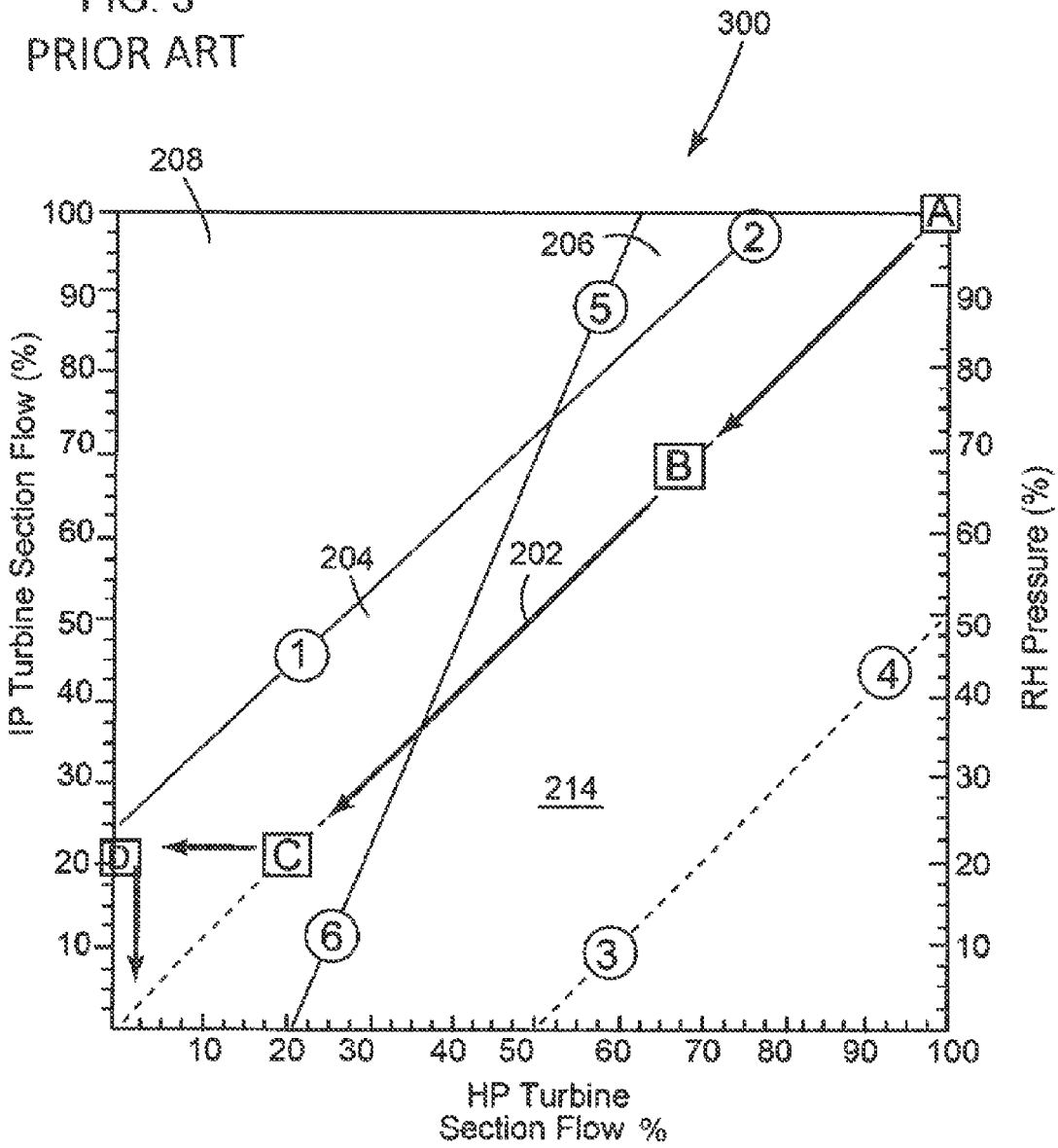
FIG. 3 PRIOR ART
FIG. 3 is another chart illustrating IP section flow versus HP section flow and RH pressure versus HP section flow for the steam turbine in an ATOS environment, in accordance with a known shutdown methodology.

FIGS. 2 and 3 are schematic illustrating the potential issues with known shutdown methodologies viewed with in ATOS environment. Balanced flow may be considered as a methodology and/or control philosophy that seeks to provide the same quantity of steam flow to each section 110, 112, as the steam turbine 102 is shutting down. Embodiments of the present invention seek to replace the balanced flow approach and expand the operating boundaries of the steam turbine 102. As the steam turbine 102 operates, the control system 106 may determine ATOS. ATOS may be considered to be the current operational boundaries of the steam turbine 102. As ATOS changes, embodiments of the present invention may adjust the positions of valves 116, 118 to change the amount steam flow into the sections 110, 112.

The following should be considered when reviewing the FIGS and corresponding discussion on ATOS. All figures should be considered non-limiting examples that may be associated with certain steam turbine 102 configurations. Furthermore, the numerical ranges on each figure are for illustrative purposes of a non-limiting example. The FIGS may not reflect the length of time the steam turbine 102 may operate or traverse each limiting boundary. ATOS should be considered a region within which a steam turbine 102 may operate. Each ATOS boundary, discussed and illustrated below, should not be considered a fixed or limiting boundary. ATOS, and its associated boundaries should be considered a changing and dynamic operating environment. This environment is determined, in part, by the configuration, operational phase, boundary conditions, and mechanical components and design of the steam turbine 102. Other directions, shapes, sizes, magnitudes, and sizes of ATOS and its boundaries, not illustrated in the figures, do not fall outside of the nature and scope of embodiments of the present invention. Therefore, the direction, magnitude, shape, and size of ATOS and its boundaries, as illustrated in the figures, are merely illustrations of non-limiting examples.

FIG. 2 is a chart 200 illustrating IP section flow versus HP section flow and RH pressure versus HP section flow for the steam turbine in an ATOS environment, in accordance with a known shutdown methodology. FIG. 2 illustrates a non-limiting example of ATOS 214 of the steam turbine 102, in accordance with an embodiment of the present invention. Here, the ATOS boundaries are lines 2-6 (which is a combination of the intersection of lines 1-2 and 5-6) and line 3-4. Line 1-2 may be considered an IP/LP Thrust Line and indicates the maximum allowable IP section flow as a function of the HP section flow to maintain axial thrust within limits. Line 3-4 may be considered an HP Thrust Line; and indicates the maximum allowable HP section flow as a function of the IP section flow to maintain axial thrust within limits. Line 5-6 may be considered an HP section Exhaust Windage Line and indicates the maximum allowable RH pressure as a function of HP section flow to prevent undesirably high temperatures at the exhaust of the HP section.

The X-axis illustrates steam flow through the HP section 110. The left Y-axis illustrates steam flow through the IP section 112 and the right Y-axis illustrates a RH pressure. The natural pressure line 202, illustrates the balanced flow strategy, as previously discussed.

The thrust lines 1-2 and 3-4 are a function of steam flow through the opposing HP and IP sections 110, 112. Lines 1-2 and 3-4 may represent the allowable flow imbalance that a specific steam turbine 102 may tolerate before experiencing an undesirably high axial thrust load. The actual shape and associated values of these lines depend, inter alia, on the thermodynamic design of each section 110, 112 and the size of the associated thrust bearing. Advanced steam turbine designs may increase the axial thrust force and limit the allowable flow imbalance, reducing ATOS 214. Similarly, increasing the thrust bearing size may allow greater flow imbalance and increase ATOS 214.

The HP section Exhaust Windage Line, line 5-6, may be a function of the minimum HP flow required to prevent undesirably high temperatures at the latter stages of the HP section 110; as a function of the RH pressure and HP inlet steam temperature. Higher RH pressure may drive higher pressure at the HP section exhaust. This may decrease the pressure ratio through the HP section 110, for a given flow and a given HP inlet steam temperature. This may also increase the HP exhaust temperature. Similarly, higher HP inlet steam temperature may also increase the HP section exhaust steam temperature, for a given steam flow at a given RH pressure.

During the operation of some steam turbines 102, the HP section exhaust temperature may approach material-specific limiting values when the RH pressure reaches a higher than desired condition with high inlet steam temperature. However, as the steam turbine 102 operates at reduced inlet steam temperatures, the likelihood of high HP section exhaust temperature is lessened even with high RH pressure. Here, the enthalpy of HP inlet steam reduces significantly with reduced temperature. Therefore, the HP section windage considerations may be limiting in certain conditions, such as, but not limiting of, when the steam temperature is high.

As discussed, lines 1-2, 3-4, and 5-6 are boundaries that may define ATOS 214 at a given operational condition. These lines are dynamic in nature. Therefore, the ranges illustrated in FIG. 2 merely illustrate of a non-limiting example. As the steam turbine 102 is shutting down under the known methodology, the steam flows in the HP and IP sections 110, 112 are fairly equal between points A and C. Next, at point C, the steam turbine 102 may be transferred out of HP forward flow mode. Here, the control valve 116 is closed. FIG. 2 illustrates that at point D, the IP flow, after transferring out of HP forward flow mode, may be above the desirable range.

FIG. 2 also illustrates a condition where RH pressure reduces as flow through IP section 112 is reduced; indicated by the arrows adjacent the right Y-axis. However, and as illustrated in FIG. 3, the reduction in RH pressure may not coincide with the reduction in steam flow through the IP section 112.

FIG. 3 is another chart 300 illustrating IP section flow versus HP section flow and RH pressure versus HP section flow for the steam turbine in an ATOS environment, in accordance with a known shutdown methodology. Here, the reduction in RH pressure does not coincide with the reduction in steam flow through the IP section 112. Here the steam flow through the HP and IP sections 110, 112 are relatively balanced as the steam turbine 102 is unloaded from point A to point C. Next, at point C, the steam turbine 102 may be transferred out of the HP forward flow mode. Here, the control valve 116 is closed. FIG. 3 illustrates that at point D, the IP flow, after transferring out of HP forward flow mode, may be within the desirable range. However, the RH pressure may linger around 100%, as the HP flow is reduced from point C to point D, under the balance flow methodology. This reduction in HP flow may be less than the minimum flow required to prevent high temperature at HP section exhaust, as illustrated via line 5-6. Therefore, if the RH pressure remains undesirably high, then the HP section exhaust temperature increases as the HP flow is reduced from points B to C.

Figure 4:
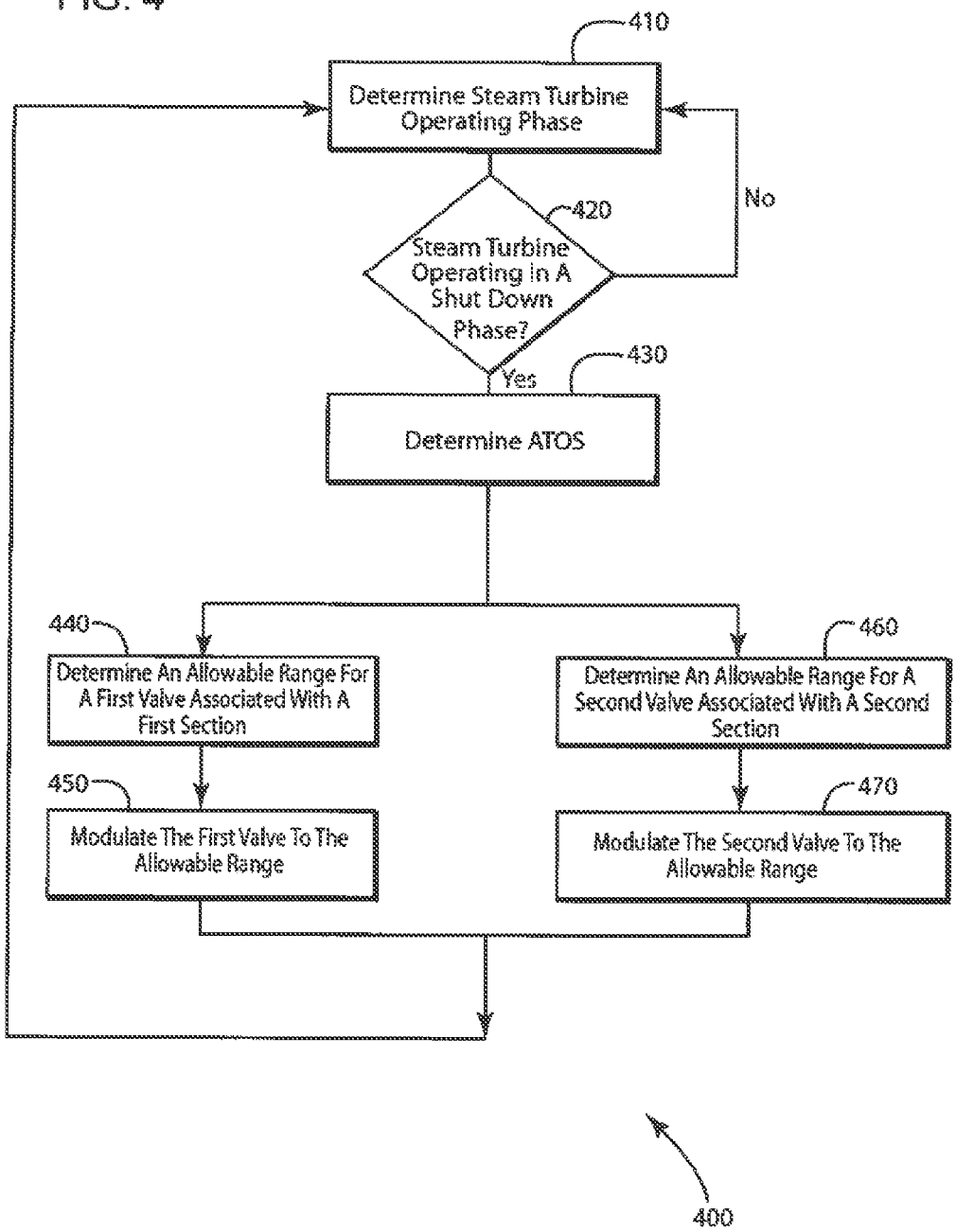
FIG. 4 is a flowchart illustrating an example of a method for controlling steam flow within ATOS, in accordance with an embodiment of the present invention.
Figure 5:
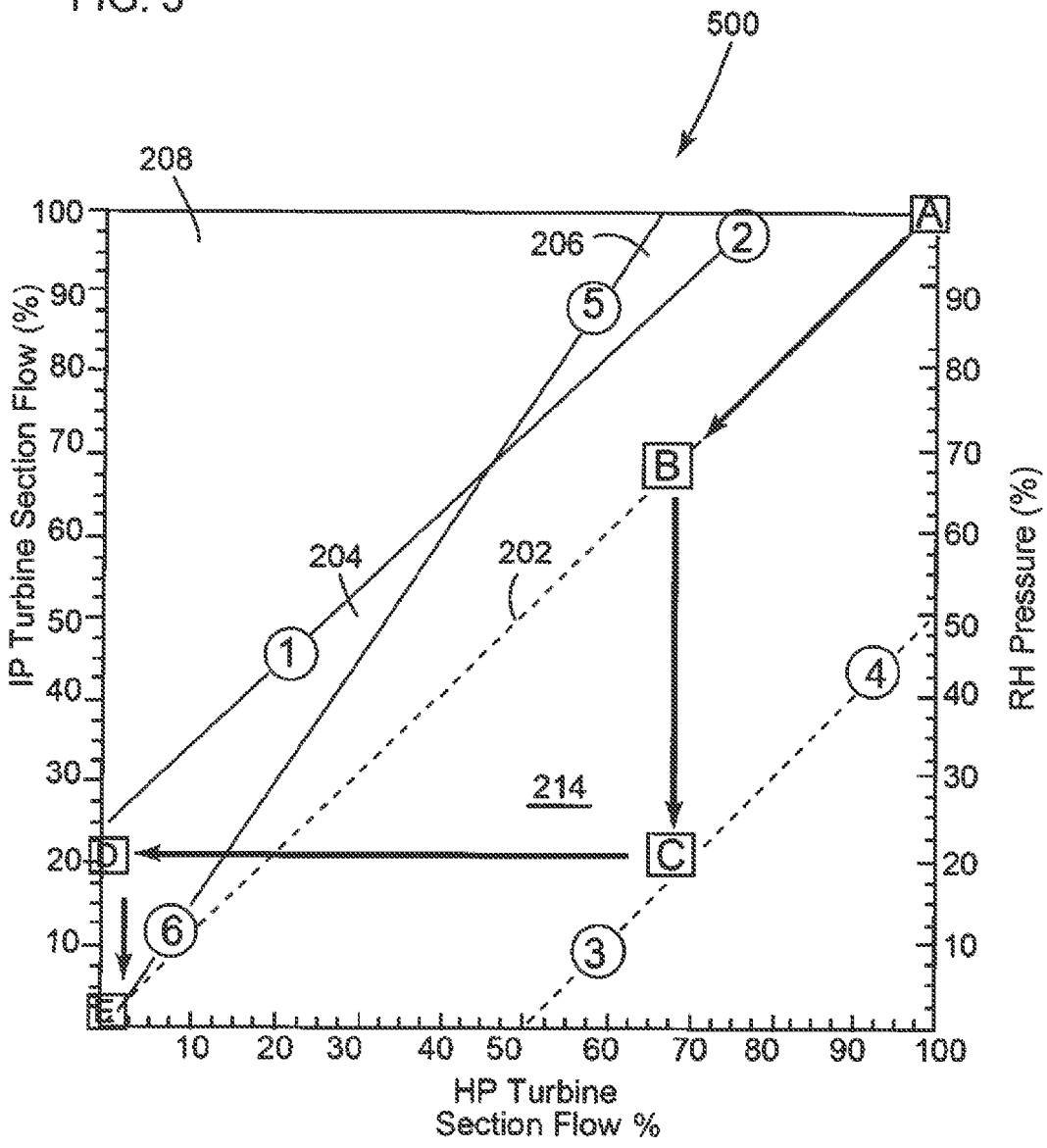
FIG. 5 is a chart of IP section flow versus HP section flow and RH pressure versus HP section flow illustrating a methodology for increasing the operability of a steam turbine within ATOS, in accordance with an embodiment of the present invention.

FIGS. 4 and 5 are schematics illustrating a method of using ATOS 214 to expand the operability of each section 110, 112 during the shutdown phase. In an embodiment of the present invention, ATOS allows for the decoupling of the steam flow through the HP section 110, and the IP section 112 during the shutdown phase. Essentially, embodiments of the present invention split the steam flows to each section 110, 112 and do not incorporate a balanced flow methodology. This may reduce the possibility of a thrust bearing overload and excessive heating of the exhaust of the HP section 110.

Embodiments of the present invention may determine, in real time, ATOS 214; and allow greater operational flexibility. In practical terms, each ATOS boundary may be considered a physical parameter that defines ATOS 214 of a specific steam turbine 102. The physical parameter may include, but is not limiting to: axial thrust, rotor stress, steam temperature, steam pressure, and exhaust windage limit. Areas 204, 206, and 208 denote the regions where the operation of the steam turbine 102 may exceed the preferred limits of the exhaust temperature and/or thrust.

FIG. 4 is a flowchart illustrating an example of a method 400 for controlling steam flow within ATOS, in accordance with an embodiment of the present invention. As discussed, embodiments of the present invention incorporate an unbalanced flow method to manage steam flow during the shutdown phase. Here, the steam flow entering each section 110, 112 is intentionally unbalanced to expand the operational boundaries and flexibility of the steam turbine 102. This may be accomplished by independently controlling the amount of steam entering each section 110, 112, in real-time. The method 400 may be integrated with the control system 106 that operates the steam turbine The method 400 may control the first valve 116 and the second valve 118 for controlling steam flow through the first section 110 and the second section 112 respectively. In various embodiments of the present invention, the first valve 116 and the second valve 118 may be the control valve 116 and the intercept valve 118 that control steam flow through the HP section 110 and the IP section 112 respectively, as previously discussed.

In step 410, the method 400 may determine the which operating phase of the steam turbine 102. As discussed, the steam turbine 102 normally operates in the three distinct, yet overlapping, phases; startup, loading, and shutdown.

In step 420, the method 400 may determine whether the steam turbine 102 is operating in the shutdown phase. Here, the method 400 may receive operating data or operational data from a control system 106 that operates the steam turbine 102. This data may include, but is not limited to, positions of the valves 116, 118. If the steam turbine 102 is operating in the shutdown phase then the method 400 may proceed to step 430; otherwise, the method 400 may revert to step 410.

In step 430, the method 400 may determine the current ATOS 214. Here, the method 400 may receive current data related to the ATOS boundaries, as described. The method 400 may receive data on the physical parameter associated with the ATOS boundaries. This data may be compared to the allowable or the preferred limits and the boundaries. For example, but not limiting of, an ATOS boundary may include a axial thrust and/or exhaust temperature of the HP section 110. Here, the method 400 may determine the current axial thrust and allowable axial thrust for the current operating conditions.

In an alternate embodiment of the present invention, the method 400 may incorporate a transfer function, algorithm, or the like to calculate, or otherwise determine ATOS 214.

In step 440, the method 400 may determine an allowable range of a physical parameter associated with at least one of the first section 110 of the steam turbine 102. The physical parameter may include, but is not limiting to, an operational and/or physical constraints. These constraints may include, but are not limited to: axial thrust, rotor stress, steam temperature, steam pressure, or HP section exhaust windage limit. The method 400 may then generate a range of valve strokes for the first valve 116 based on the allowable range of the physical parameter.

In step 450, the method 400 may modulate the first valve 116 to allow steam flow into the first section 110 of the steam turbine 102. The method 400 may modulate the first valve 116 based on the allowable range of the physical parameter.

In step 460, the method 400 may determine an allowable range of a physical parameter associated with at least one of the second section 112 of the steam turbine 102. The physical parameter may include, but is not limiting to, an operational and/or physical constraints. These constraints may include, but are not limited to: axial thrust, rotor stress, steam temperature, steam pressure, or HP section exhaust windage limit. The method 400 may then generate a range of valve strokes for the second valve 118 based on the allowable range of the physical parameter.

In step 470, the method 400 may modulate the second valve 118 to allow steam flow into the second section 112 of the steam turbine 102. The method 400 may modulate the second valve 118 based on the allowable range of the physical parameter.

Embodiments of the present invention allow real time determination of a change in the physical parameters that bound ATOS 214. Therefore, after steps 450 and 470 are completed, the method 400 may revert to step 410.

FIG. 5 is a chart 500 of IP section flow versus HP section flow and RH pressure versus HP section flow illustrating a methodology for increasing the operability of the steam turbine 102 within ATOS 214, in accordance with an embodiment of the present invention.

Essentially, FIG. 5 illustrates the potential results of an application of the method 400 of FIG. 4. As discussed, embodiments of the present invention provide an unbalanced flow methodology for the shutdown phase. This methodology seeks to determine the allowable steam flow for each section 110, 112, based on the current ATOS 214.

Similar to FIG. 3, the X-axis illustrates steam flow through the HP section 112. The left Y-axis illustrates steam flow through the IP section 114 and the right Y-axis illustrates the RH pressure. The line 202 illustrates the natural pressure line, as discussed in FIG. 2. In an embodiment of the present invention, a transfer function, algorithm, or the like may determine the current operational ranges of a physical parameter associated with the HP section 112 and/or the IP section 114 based on the determined ATOS 214. As discussed, lines 1-2, 3-4, and 5-6 are boundaries that may define ATOS 214 at a given operational condition. These lines are dynamic in nature. Embodiments of the present invention may determine, in real time, ATOS 214; and allow greater operational flexibility. Practically, each ATOS boundary may be considered a physical parameter that defines ATOS 214 of a specific steam turbine 102.

In use, an embodiment of the present invention provides a new shutdown phase methodology for the steam turbine 102, which may include multiple stages. In an embodiment of the present invention, each stage may be based, at least in part, on a current ATOS boundary.

As discussed, the numerical ranges discussed and illustrated on FIG. 5 are for illustrative purposes of a non-limiting example. Each ATOS boundary should not be considered a fixed or limiting boundary. ATOS 214, and its associated boundaries should be considered a changing and dynamic operating environment; which are determined, in part, by the configuration, operational phase, boundary conditions and mechanical components and design of each steam turbine 102. Therefore, the direction, magnitude, shape, and size of ATOS 214 and its boundaries, as illustrated in FIG. 5, is merely an illustration of a non-limiting example, discussed below. Other directions, shapes, sizes, magnitudes, and sizes of ATOS 214 and its boundaries, not illustrated in the FIG. 5, do not fall outside of the nature and scope of embodiments of the present invention.

The following provides a non-limiting example of an embodiment of the present invention, in use during a shutdown phase. In an embodiment of the present invention, the shutdown process of the steam turbine 102 may include multiple stages, illustrated in FIG. 5 as points A to D.

At point A, the steam turbine 102 may be operating at base load. Here, the steam flow through the HP and IP sections 110, 112 may be substantially equal. As discussed, the RH pressure may not decrease at the same rate, if at all, as the steam flow through the HP and IP sections 110, 112. For example, but not limiting of, the magnitude of the RH pressure may remain substantially constant throughout shutdown phase, as illustrated by an arrow in FIG. 5. Between points A and B, steam flow between the HP and IP sections 110, 112 may be reduced at nearly equal rates until reaching an intermediate point. As illustrated in FIG. 5, the steam flow entering the HP and IP sections 110, 112 may be reduced to approximately 68%.

At point B, the spilt-flow strategy may reduce the steam flow into HP and IP sections 110, 112 at significantly different rates. The at least one physical parameter associated with ATOS 214 may be used to determine the allowable ranges of the steam flow entering the HP and IP sections 110, 112. Here, the RH pressure remains undesirably high during the shutdown phase, thus requiring HP section flow to be a value equal to the value on X-axis at Point B.

From point B to point C, steam flow into the IP section 112 may be reduced significantly while steam flow into the HP section 110 remains substantially constant. Here, the magnitude of the steam flows into these sections 110, 112 may be constrained by the at least one physical parameter. ATOS 214 allows a reduction of steam flow into the IP section 112. Embodiments of the present invention may prevent thrust bearing overload in the IP direction when HP section steam flow is reduced or non-existent. Other embodiments of the present invention may prevent thrust bearing overload in the HP direction when IP section steam flow is reduced or non-existent.

At point C, steam flow into the HP section 110 may be maintained at a minimum required value. This may prevent high HP section exhaust temperature, which may be associated with high RH pressure. As illustrated in FIG. 5, at point C, steam flow into the HP section 110 may be approximately 68%; while steam flow into the IP section 112 may be reduced to a level near line 5-6, approximately 20%.

At point D, steam flow into the HP section 110 may be substantially stopped. Here, the control valve 116 may be closed, as steam flows into the IP section 112 may remains substantially constant.

At point E, steam flow into the IP section 112 may be substantially stopped. Here, the intercept valve 118 may be closed. Point E represents the completion of the shutdown phase.

Embodiments of the present invention describe a shutdown strategy utilizing physical parameters and a real time determination of ATOS 214. Determining the allowable amount of steam that may enter each section 110, 112 may prevent thrust bearing overload and may also protect against high HP section exhaust temperatures.

Although specific embodiments have been illustrated and described herein, those of ordinary skill in the art appreciate that any arrangement which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of reducing steam flow during a shutdown phase of a turbomachine, the method comprising:

a. providing a turbomachine comprising at least a first section and a second section, and a rotor partially disposed within the first section and the second section;

b. providing a first valve configured for controlling steam flow into the first section; and a second valve configured for controlling steam flow into the second section;

c. determining whether the turbomachine is operating in a shutdown phase; which begins when a load on the turbomachine is reduced and steam flow into each section is gradually stopped and the rotor is slowed to a turning gear speed;

d. determining an allowable turbine operating space (ATOS) which approximates operational boundaries for each section of the turbomachine, wherein ATOS incorporates data from at least one of the following: steam flow through each section, a thrust limit of each section, and an exhaust windage limit;

e. determining an allowable range within ATOS of a physical parameter associated with the shutdown phase;

f. modulating the first valve to reduce steam flow entering the first section, wherein the modulation is partially limited, by the allowable range of the physical parameter;

g. modulating the second valve to reduce steam flow entering the second section, wherein the modulation is partially limited by the allowable range of the physical parameter; and h. wherein ATOS, in real time, expands operational boundaries of the first section and the second section, and allows unbalanced steam flow between the first section and the second section of the turbomachine during the shutdown phase.

2. The method of claim 1, wherein the turbomachine comprises a steam turbine.

3. The method of claim 2, wherein the steam turbine comprises an opposed flow turbine integrated with a cascade steam bypass system.

4. The method of claim 3, wherein the physical parameter comprises at least one of: axial thrust, rotor stress, steam temperature, steam pressure, or an exhaust windage limit.

5. The method of claim 4, wherein a value of the physical parameter is determined by a transfer function algorithm, which is configured for independently controlling steam flow into at least one of the first section or the second section.

6. The method of claim 5, wherein the transfer function algorithm limits the steam flow based on ATOS.

7. The method of claim 6, wherein the first section comprises a HP section; and wherein the second section comprises an IP section.

8. The method of claim 7, wherein the transfer function algorithm determines an operational space of the steam turbine during the shutdown process, and wherein the operational space determines current operational ranges of the HP section and the IP section.

9. The method of claim 8 further comprising adjusting the desired strokes of the first valve and the second valves, based on the current operational ranges of the HP section and the IP sections.

10. The method of claim 9, wherein the shutdown process comprises multiple stages, and wherein each stage is partially determined by the current operational ranges.

11. A method of independently apportioning steam flow between sections of a steam turbine during a shutdown process, the method comprising:

a. providing a power plant comprising a steam turbine, wherein the steam turbine comprises a HP section, an IP section, and a rotor partially disposed within the HP and IP sections;

b. providing a first valve configured for controlling steam flow entering the HP section; and a second valve configured for controlling steam flow entering the IP section;

c. determining whether the steam turbine is operating in a shutdown phase;

d. determining an allowable turbine operating space (ATOS), wherein ATOS incorporates data on at least one of the following: steam flow through each section, a thrust limit of each section, and an exhaust windage limit to approximate operational boundaries for each section of the turbomachine;

e. determining an allowable range within ATOS of a physical parameter associated with at least one of the first section or the second section;

f. generating a range of valve strokes for the first and second valves based on the allowable range of the physical parameter;

g. modulating the first valve to reduce steam flow into the HP section, wherein the modulation limits the range of valve strokes for the first valve; and h. modulating the second valve to reduce steam flow into the IP section, wherein the modulation limits the range of valve strokes for the second valve; and wherein the physical parameter allows apportioning steam flow into the HP and the IP sections, during the shutdown phase of the steam turbine, wherein the steam turbine comprises multiple sections with each section integrated with at least one valve; and wherein the steam turbine is integrated with a cascade steam bypass system wherein the physical parameter comprises at least one of: axial thrust, rotor stress, steam temperature, steam pressure, or an exhaust windage limit, wherein a value of the physical parameter is determined by a transfer function algorithm, which is configured for independently controlling steam flow entering at least one of: the HP section or the IP section, and wherein the multiples stages comprises:

a. Shutdown initiated to stage A—which comprises initial shutdown of the steam turbine, wherein full steam flow is substantially balanced between the HP section and the IP section;

b. Stage A to stage B—wherein steam flow to the HP section and the IP section are reduced and steam flow is balanced between the HP section and the IP section;

c. Stage B to stage C—wherein steam flow to the HP section is maintained at a nearly constant rate; and steam flow to the IP section is decreased to the current operational range of the IP section;

d. Stage C to stage D—wherein steam flow to the HP section is stopped; and steam flow to the IP section is maintained at a nearly constant rate; and e. Stage D to completed shutdown—wherein steam flow to the IP section is stopped.

* * * * *